United States Patent [19]

Trame

[11] Patent Number: 4,577,428

[45] Date of Patent: Mar. 25, 1986

[54] DISPLAY DEVICE WITH MOVABLE TAPE ASSEMBLIES

[75] Inventor: Charles E. Trame, Mequon, Wis.

[73] Assignee: Everbrite Electric Signs, Inc., South Milwaukee, Wis.

[21] Appl. No.: 631,932

[22] Filed: Jul. 18, 1984

Related U.S. Application Data

[63] Continuation-in-part of Ser. No. 508,015, Jun. 27, 1983, abandoned.

[51] Int. Cl.[4] ..... G09F 11/18

[52] U.S. Cl. ..... 40/518; 40/5; 40/10 R

[58] Field of Search ..... 40/5, 10, 518

[56] References Cited

U.S. PATENT DOCUMENTS

| | | | |
|---|---|---|---|
| 3,014,294 | 12/1961 | Singer | 40/5 |
| 3,513,577 | 5/1970 | Kleinman | 40/518 |
| 4,296,563 | 10/1981 | Clement | 40/5 |
| 4,375,730 | 3/1983 | Sanders et al. | 40/5 |

FOREIGN PATENT DOCUMENTS

| | | | |
|---|---|---|---|
| 811318 | 4/1959 | United Kingdom | 40/5 |

*Primary Examiner*—Gene Mancene
*Assistant Examiner*—Wenceslao J. Contreras
*Attorney, Agent, or Firm*—Fuller, House & Hohenfeldt

[57] ABSTRACT

A device for displaying the names of items and their prices uses a generally planar panel that has pairs of parallel tracks on its rear side and parallel guide channels on its front side. There is an elongated aperture in the panel between each pair of tracks and guide channels. Strips bearing printed item names and other information are inserted in the channels. The strips have variable numbers of either apertured or transparent windows aligned with the aperture. A tape carrier for tapes bearing indicia such as numerals for composing prices that are displayed through the windows is engageable with the rear tracks by means of its inherent flexure property. Divider members engage the carrier with a snap action and they create channels in conjunction with the carrier surface for guiding and restraining the edges of the tapes against all but longitudinal movements.

15 Claims, 8 Drawing Figures

DISPLAY DEVICE WITH MOVABLE TAPE ASSEMBLIES

This application is a continuation-in-part of application Ser. No. 508,015, filed June 27, 1983 now abandoned.

BACKGROUND OF THE INVENTION

This invention relates to a device such as is used in restaurants and stores to display names of items that are on sale and their prices.

An important objective achieved with the new display device is to permit changing information that is displayed by simply withdrawing from the display panel a strip that contains printed matter identifying the item or items on sale and substituting a strip showing other items.

Another important objective achieved with the invention is to make those parts which are interchangeable to accomplish display of different information removable and installable without requiring use of tools.

SUMMARY OF THE INVENTION

In accordance with the invention, the display device comprises a generally planar panel that has parallel tracks on one side and means for detachably holding elongated planar strips on the other side. The panel has an aperture between the tracks. The strips have a plurality of windows through which indicia, such as the digits comprising a price, may be viewed. The indicia are printed on longitudinally movable tapes. The tapes are supported on a channel-shaped tape carrier that is detachably engaged with the tracks at the back of the panel. The tape carrier comprises a body having a front platen portion which is overlaid by the tape for the indicia to be presented through the windows in the strip. A notable feature of the carrier is that it has leg portions extending rearwardly from the platen that are comprised of a sufficiently resilient material for allowing the leg portions to be flexed toward each other to contract the carrier and thereby permit it to be inserted between the tracks so it can expand when the force is relieved to thereby juxtapose the platen, which is overlaid by the tapes, to said aperture. Divider members engageable with the tape carrier from its front side have guide portions that overlay the platen portion to thereby define laterally spaced apart channels for retaining the tape on the platen and for guiding its longitudinal movement.

A more detailed description of a preferred embodiment of the invention will now be set forth in reference to the drawings.

DESCRIPTION OF A PREFERRED EMBODIMENT

Figure 1:
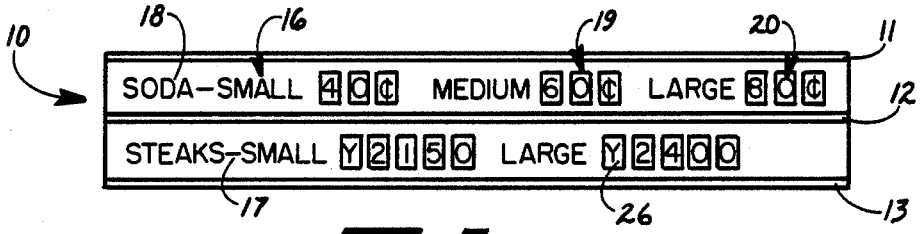
FIG. 1 is a front elevation view of a panel that is used in the new display device but is isolated from its mounting.

FIG. 1 shows a typical panel used in the new display as it is seen from the front by an observer. The panel is designated generally by the reference numeral 10. It can be extruded or fabricated by other methods. The panel has some strip guiding ridges, 11, 12 and 13, which are actually T-shaped in cross-section and can be seen clearly in FIG. 3. In the latter figure one may see that heads of the T-shaped members define slots such as those marked 14 and 15 which serve as guides or holders for information bearing strips, such as those marked 16 and 17. These strips are insertable and removable by sliding them in-and-out between the guide slots. The strips typically have information, such as the names 18 of items on sale, printed on them. The strips are usually composed of a transparent plastic material on which translucent letters and numbers are printed by the silk screen process, for example, and the background for the printing is a coating of opaque material. Thus, the printed information on the strips can be illuminated from the rear or the front.

Figure 4:
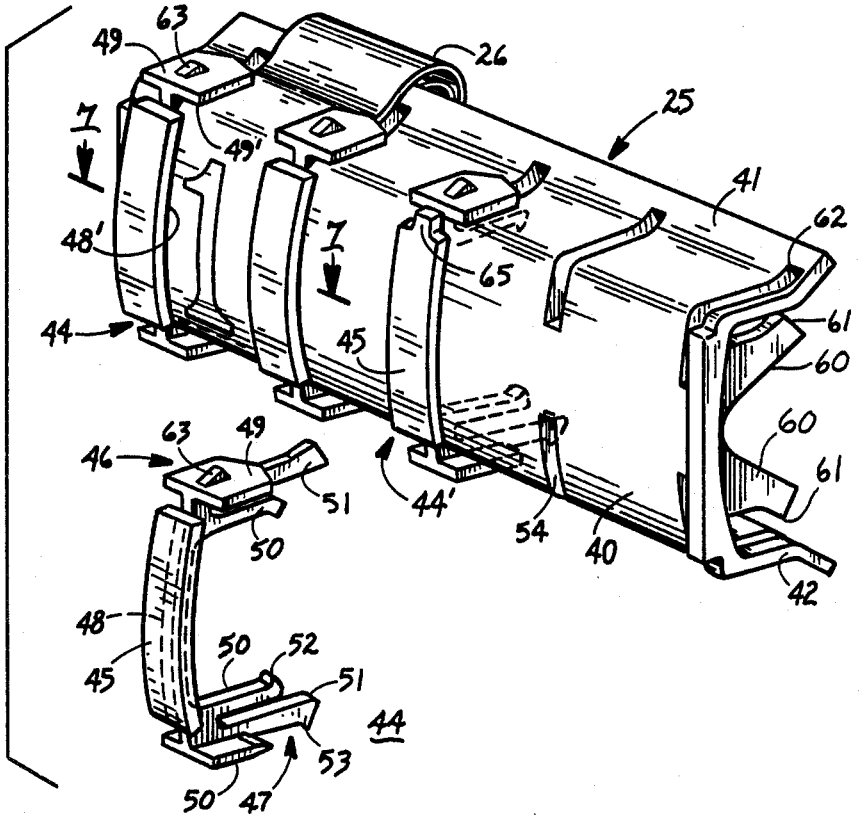
FIG. 4 is a perspective view of a tape carrier used in the display device.
Figure 8:
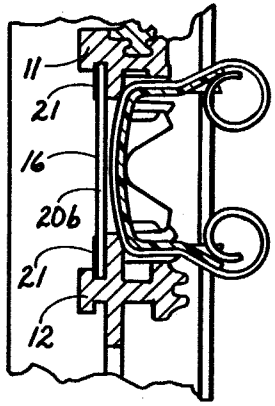
FIG. 8 is a partial transverse sectional view similar to FIG. 3 but showing a modified construction of a portion of the present invention.

As can be seen in FIG. 1, the strips 16 and 17 have a plurality of windows, a typical window in one group is marked 19 and one in another group is marked 20. In the construction illustrated in FIG. 3, the windows 19 and 20 in the strips consist of apertures **20*a* extending through the strips. Alternatively, to prevent tampering with the tape 26, the windows 19 and 20 may consist of clear or transparent panes 20*b* in the strips 16 and 17 which allow viewing of the indicia on the tapes behind the panes, FIG. 8. For instance, the strips 16 and 17 can be made of clear plastic coated with opaque ink or other material, as at 21, by the silk screening process, but leaving the clear panes 20*b* through which the indicia can be seen. Numerals showing in the apertures 20*a* or panes 20*b* are those which compose prices of the items printed on the strips. The indicia or numerals that are visible through the windows are translucent and are printed on plastic self-coiling tapes 26 which are supported on a tape carrier that is generally designated by the numeral 25 and is depicted in FIG. 4. The tapes are supported by and run on carrier 25. One tape is installed on the carrier and is marked 26 in FIG. 3**. Self-coiling tapes of the type described in U.S. Pat. No. 3,426,115 are used. A prior art display device in which self-coiling indicia bearing tapes are used is described in U.S. Pat. No. 3,939,584 which is assigned to the assignee of the present application.

Figure 6:
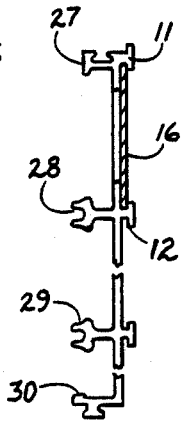
FIG. 6 is a side view of the panel.
Figure 3:
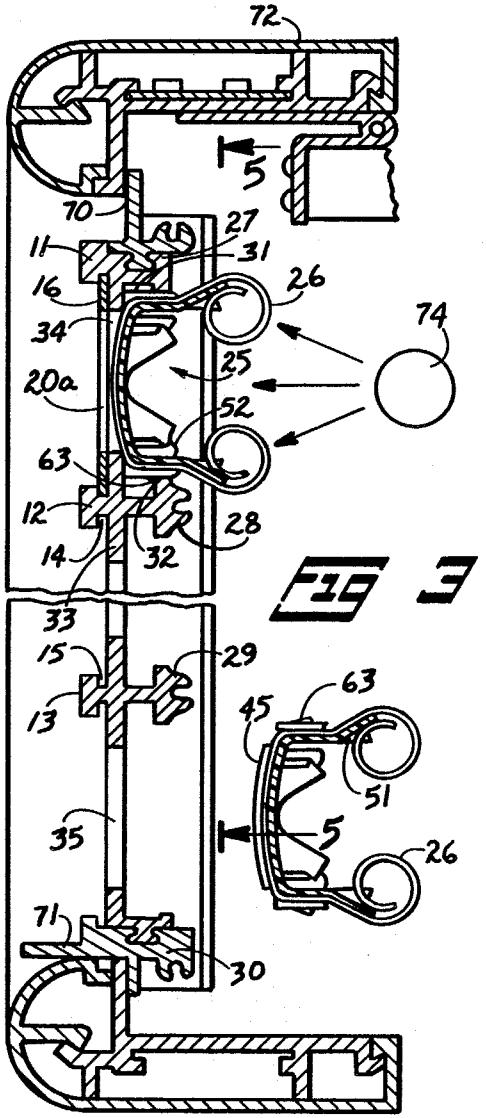
FIG. 3 is a section taken through the device on a line corresponding with 3—3 in FIG. 2.

By referring to FIG. 3 one may see that generally planar panel 10 has a plurality of parallel track means such as those marked 27, 28, 29 and 30 projecting from its rear. These track means are substantially coextensive with the length of panel 10. The track means have shoulders such as those marked 31 and 32 which are spaced from a rear planar surface 33 of panel 10. An end view of panel 10 may also be seen in FIG. 6. As shown in FIG. 3, panel 10 also has laterally extending apertures such as those marked 34 and 35. These apertures are substantially coextensive with the lateral dimension of the panel 10 and with the parallel track means 27–30 on the rear side of the panel. One or more tape carriers 25 of the type depicted in FIGS. 3 and 4 can be inserted between any adjacent pair of track means such as 27 and 28 with a snap action and the carriers 25 can be slid laterally on the track means to align their indicia bearing tapes with the apertured viewing windows 20*a* or panes 20*b* in the front strips 16 whereupon the carriers lock in proper position as will be explained.

The tape carrier 25 will now be discussed in reference to FIGS. 4 and 3. In FIG. 4, carrier 25 is comprised of an arch-shaped body having a front platen portion 40 and integral rearwardly extending leg portions 41 and 42. The body is preferably made of a transparent plastic material having such thickness and flexure or resilient properties as to allow the leg portions 41 and 42 to be forcibly flexed toward each other by applying one's fingers to the respective leg portions and squeezing them toward each other. This reduces the height dimension of the carrier body, particularly in the curved regions where the platen portion 40 continues into the leg portions 41 and 42. When the leg portions 41 and 42 are squeezed toward each other, the body will fit in between a pair of parallel tracks 27 and 28. When the flexing force from the fingers is removed, leg portions 41 and 42 expand outwardly away from each other to effect a gripping force between the carrier body and the track means on the back of panel 10. When the carrier is simply inserted in the track means in a position other than that in which it is finally to be locked, the carrier 25 can be slid laterally along the tracks until it finally reaches a position where it becomes locked to panel 10. Means are provided for causing locking to occur when the tapes 26 that run over the platen portion 40 of the carrier are aligned with the windows 20*a* of the apertured type or 20*b* of the transparent type in the front information carrying removable strips 16.

Figure 7:
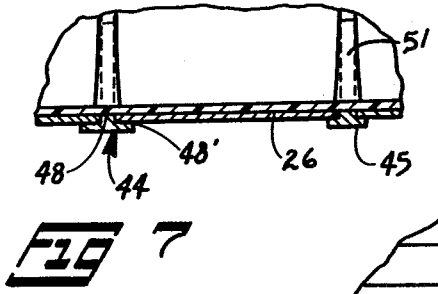
FIG. 7 is a partial transverse section taken on a line corresponding with 7—7 in FIG. 4.

The tapes are guided for longitudinal movement across platen portion 40 of the carrier by means of divider members which are designated generally by the reference numeral 44. The divider members are engageable with the front or platen side 40 of carrier 25 and they are installed in the carrier body after the self-coiling tapes are put on the body and before the carrier 25 is snapped into place between the track means on the back of panel 10. The divider members 44 are preferably molded from a plastic material that can withstand some bending or flexing without fracturing. A typical divider has an optionally straight or curved section 45 that has means 46 and 47 at opposite ends for securing divider means in the body of carrier 25. As shown in hidden lines in the divider member that is separated from the carrier body 25 in FIG. 4, and as can be seen in FIG. 7, the curved section 45 of each divider has a rib 48 on its concave side which serves to keep the edges of curved section 45 in spaced relation from platen surface 44 when the divider members are snapped into place on the carrier body. The rib 48 thus causes a channel or groove 48' to be created between the edges of curved section 45 and curved platen portion 40 of the carrier. The side edges of the tape 26 are thereby overlapped by the edges of curved sections 45 so as to provide guidance and stability for tape 26 as it is translated longitudinally, or up and down, across the curved platen portion 40 of the carrier. As is typical of display devices that use self-coiling tapes, the tape is moved to display selected indicia in the front window by pressing against the tape with a finger and moving the finger in one direction or another to slide the tape over the platen portion whereupon one end of the tape uncoils and the other end coils. The platen 40 acts as a backup member for preventing the tape from being collapsed inwardly of the carrier when it is being pressed by the finger. With the apertured windows 20*a* of FIG. 3, the strip 16 need not be removed from the display panel. Rather, the finger may be inserted through the window apertures 20*a* for contacting and moving the tape 26. If the strip 16 utilizes the anti-tamper transparent window panes 20*b*, FIG. 8, the strip 16 must be removed to allow access to the tape for changing indicia. It is preferable for the platen portion 40 of the carrier and for the sections 45 of the divider members to be curved as shown, but they could be straight, especially in small display devices where there is little bulging out of the tapes.

Integral with the curve sections 45 of dividers 44 there are some pads 49 and 50 which overlay the leg portions 41 and 42 of the carrier 25 when the divider members are installed in the carrier. These pads are slightly spaced from the leg portions of the carrier body so as to define a lateral groove or channel 49' which is an extension of channel 48' and provides further guidance for the edges of the tape. There are pairs of latch prongs 50 and 51 extending rearwardly under each of the pads 49 and 50 on the divider member. Innermost latch prongs 50 terminate in a latching tooth 52 and outermost latch prongs 51 terminate in a latching tooth 53. The carrier 25 body is provided with a plurality of pairs of slots 54 and 55 through which the latch prongs of the divider member 44 can pass for effecting attachment to the carrier body. Extending integrally and rearwardly of platen portion 40 of the carrier there are a pair of lugs 60 whose outside edge is bevelled and terminates in a pointed tip or shoulder 61. Where slot 55 terminates another shoulder 62 is formed on the inside of leg portions 41 and 42. When the divider members are inserted in the slots 54 and 55, their latch prongs 50 and 51 deflect sufficiently for their toothed tips 52 and 53 to engage with shoulder 62 in the wall of the leg portions 40 and 41 and tooth tips 52 of latch prong 50 slide over and engage with the pointed ends 61 of lugs 60. Thus, the portions 40 and 41 and tooth tips 52 of latch prong 50 slide over and engage with the pointed ends 61 of lugs 60. Thus, the divider members are firmly latched in the carrier body. The tapes 26 can be fed through the guide slots or channels 48' defined by the edges of the curved portions 45 of the divider members and the platen surface 40 after the divider members are installed on the carrier body if desired. When the tapes 26 are installed on the carrier 25 it can be inserted between the track means on the back of the panel 10 by simply flexing leg portions 41 and 42 slightly toward each other and pushing the carrier in between the tracks. If the carrier is simply inserted between the tracks, it can be slid laterally along the tracks to anywhere along a laterally extending aperture 34 or 35 in the panel 10.

Figure 5:
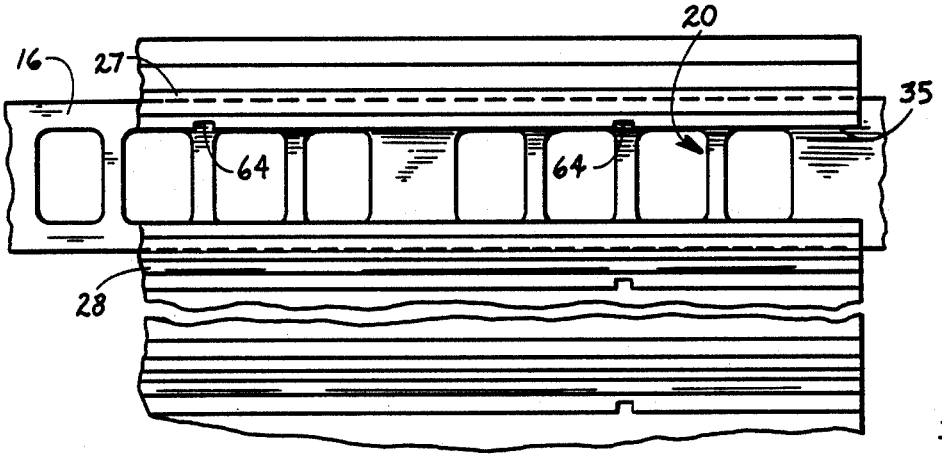
FIG. 5 is a fragmentary rear view of the panel as viewed along 5—5 in FIG. 3 but with the tape carrier omitted.

It is necessary for the indicia on the tapes carried by the carrier 25 to be centered or properly aligned with the window apertures 20*a* or window panes 20*b* in front information carrying strip 16. Means are provided to lock the carrier 25 in proper lateral position in alignment with the window apertures 20*a* or transparent panes 20*b* in strip 16 or 17. For this purpose, the divider members (depicted in greatest detail in FIG. 4) have tapered detent prongs 63 formed on their tape guide pads 49 and 50. The taper on the detent prongs 63 facilitates forcing the carrier member 25 in between the laterally extending tracks 27–30 at the rear of panel 10. The wedging action caused by the tapered detents 63 entering between the shoulders 31 and 32 can cause the leg portions 41 and 42 to deflect sufficiently so that the carrier member can be pushed straight in between the tracks without requiring very much finger pressure being used to deflect the leg portions 41 and 42 of the tape carrier 25 toward each other. As can be seen in FIG. 5, the edge of panel 10 that defines the elongated laterally extending opening or aperture 35 is provided periodically with notches 64. FIG. 4 shows how one of the divider members, particularly the center one 44' on carrier 25, has a prong or locking tab 65 extending from it. When the tape carrier 25 is pressed between a pair of tracks 27 and 28, for example, locking tab 65 may or may not register in a notch 64. However, although the carrier 25 will be engaged with the tracks at this time, the carrier can be slid or shifted in one lateral direction or the other to cause tab 65 to register in notch 64 to thereby lock the carrier against further lateral shifting. When a tab 65 on one of the divider members registers in one of the cooperating locking notches, the carrier will be fully seated between the tracks 27 and 28 and the bevelled detent elements 63 on the divider members will snap into position behind a shoulder, such as the one marked 31, on the track 28, as can be seen in FIG. 3. The action between the tapered or wedge shaped detents 63 and the shoulders on the tracks causes rearwardly extending legs 41 and 42 to flex slightly toward each other even though the legs may not be pressed together by the fingers of the person who is inserting the carrier in the tracks, so that when the carrier is fully seated between the tracks, the spring force developed in the carrier during the insertion is present to expand the legs of the carrier away from each other and thereby effect engagement between the tapered detents 63 and the edges or shoulders 31 and 32 of the tracks. The tape carrier 25 then will not release from between the tracks unless the rearwardly extending legs 41 and 42 are pressed toward each other so that the tapered detent elements 63 will clear the shoulders on the track and permit easy withdrawal of the carrier from between the tracks.

Figure 2:
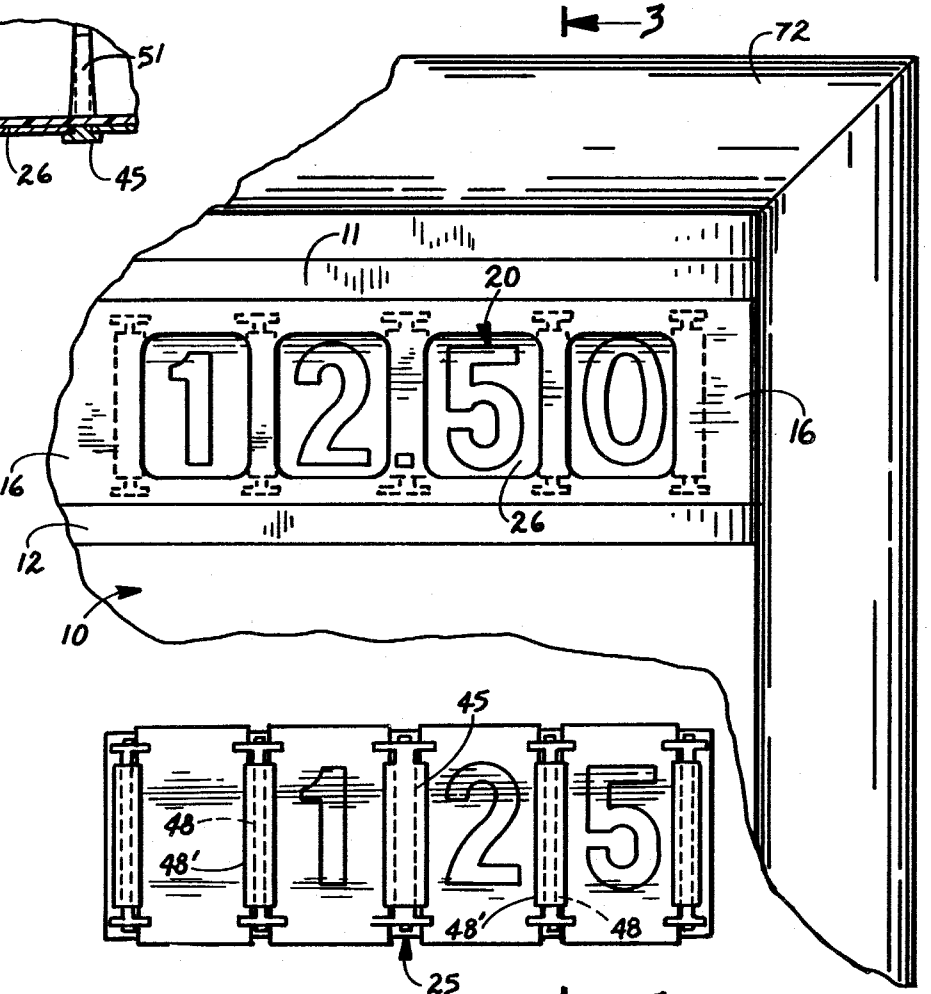
FIG. 2 is a fragmentary front elevation view of a display device in which the panel depicted in FIG. 1 is used.

The tape carrier 25 depicted in FIG. 4 is for carrying four self-coiling tapes 26. Thus, it is suitable for displaying a number, a price for example, that contains four digits. FIG. 2 shows how the four indicia bearing tapes running over platen 40 of carrier 25 may be used to display a four-digit number such as 12.50. In this case the strip 16 which is slidably mounted in the front T-shaped channels 11 and 12 on panel 10 has four window openings to permit display of a four-digit number. Note in FIG. 2 that the dividers 44, particularly the curved section 45 thereof, are concealed behind the removable front strip 16 and that the numerals are separated by the vertical segments that remain in the strip after the window openings **20*a* are cut out, FIG. 3, or by the opaque coating 21 surrounding the clear window panes 20*b*, FIG. 8**.

Carrier 25 may be made of any suitable length to accommodate more or less than four parallel running indicia bearing tapes 26. Carriers of considerable lateral length may be used, for instance, in countries where the monetary unit is small so that a large number of digits are required to form a price. An example is given in the lower part of the panel 10 in FIG. 1 where there are groups of five windows for displaying prices in terms of Yen, such as might be used in Japan. Here the price expressed in terms of Yen is displayed in four windows and a "Y" appearing on a tape in another window indicates Yen in place of a "$" sign that would be used in the United States. One should also appreciate from inspection of FIG. 1 that the new display device permits exhibiting several items and their prices in a single row or line. All that is required to accommodate a variety of price and item combinations in the new display device is to select carriers 25 that support the required number of windows of the open or transparent pane type in the strips. Stated in another way, a manufacturer does not need to make drastic changes in the basic display device design to fulfill the display requirements of different customers. Removable front strips 16 can be made with open windows or transparent windows with opaque backgrounds as required when a customer makes his display requirements known. Moreover, the same tooling can be used to make display devices of different sizes. The long extrusion can be cut up in any desired way to make front panels 10 of various lengths. Only one set of extruding dies and some panel cutoff tools are required. As has been indicated, panel 10 is provided on its front with channels such as those marked 11 and 12 for accommodating the strips 16 of the type having an opaque background and apertures or an opaque background and transparent areas through which the indicia on the tapes can be viewed. Panel 10 is provided on its rear with any number of pairs of parallel tracks 27 and 28 or 29 and 30 which are coextensive in length with the panel. Apertures 34 and 35 of any desired length can be stamped out of the front panel.

In FIG. 7, several tapes overlay the platen portion 40 of carrier 25. When the divider members 44 are snapped in place in carrier 25 as in FIG. 7, the curved section 45 of the divider members are spaced from the platen surface by the ribs 48 so that channels 48' are created for guiding the edges of tape 26 as it is moved longitudinally over the curved platen surface 40 of tape carrier 25. Tapes are translated longitudinally to effect display of selected indicia in the open windows **20*a* by pressing against the tape through an aperture in the front strip 16 with one's finger and sliding it along the platen. With the tamper proof construction of FIG. 8, the strip 16** must be removed prior to translating the tape to change the displayed indicia.

The panels 10 may be mounted into any suitable frame such as suggested in FIGS. 2 and 3. The upper and lower track portions of panel 10 in FIG. 3, for example, may be dovetailed with frame adapter members 70 and 71. The frame has a laterally extending cap member 72 which is hinged at 73 to provide access to the interior of the display device housing. There may be a light source or sources such as the one symbolized by the circle marked 74 located in the display device housing so the indicia on the tapes appears to be luminous when viewed from the front of the device. Of course, if the tapes have indicia that contrast in color or intensity with the background the indicia can be read by lighting the display device from the front.

Although the invention has been described in detail, such description is intended to be illustrative rather than limiting, for the invention may be variously embodied and is to be limited only by interpretation of the claims which follow.

I claim:

1. A device for selecting and displaying indicia that are on longitudinally movable tapes, said device comprising:

a generally planar panel having front and rear sides and at least a pair of parallel track means on the rear side, said panel having an elongated aperture between the track means, an elongated planar strip for being mounted over said aperture on the front side of said panel and said strip having a plurality of windows through which indicia may be viewed, a generally channel-shaped tape carrier having a front platen portion on which said tape is overlaid for said indicia to be presented in the aperture, said carrier having leg portions integral with and extending rearwardly from said platen portion in spaced relationship, said carrier being comprised of a sufficiently resilient material for allowing said leg portions to be forcibly flexed toward each other to contract said carrier and thereby permit it to be inserted between said track means for it to expand when the force is relieved so as to juxtapose said platen portion to said aperture, and divider members engageable with said tape carrier from its front side and having guide portions that overlay said platen portion in spaced relationship to thereby define laterally spaced apart channels through which the laterally opposite edges of the tapes pass whereby they are retained in proximity with said platen portion and are guided for longitudinal movement.

2. The device according to claim 1 including locking means on said tape carrier and said panel that are engageable to lock said carrier to the panel when said flexing force is relieved and said carrier is in a position along said aperture wherein said tape aligns with said windows.

3. The device according to claim 1 wherein said panel has one or more notches contiguous with an edge of said aperture and at least one of said divider members has tab means that is retracted from said edge when said leg members are forcibly flexed toward each other to allow said tape carrier to be slid along said aperture for aligning said tapes with said windows coincident with aligning said tab means with said notch so that when said force is relieved said tab means will register in said notch and prevent lateral movements of said carrier.

4. The device according to claim 1 wherein said tape carrier has laterally spaced apart slots and lug means projecting from the carrier rearwardly of said platen portion and adjacent the respective slots, said divider members having flexing latch prongs insertable through said slots for latching to said lug means to secure said members in the carrier and maintain the size of said channels.

5. The device according to claim 1 wherein said tape carrier has laterally spaced apart pairs of slots, the slots in each pair being spaced longitudinally from each other and each slot being formed continuously in a part of said platen portion and part of said leg portion to provide an edge at the end of the slot in the leg portion, lug means projecting from the carrier rearwardly of said platen portion adjacent the respective slots, said divider members having inner and outer flexing latch prongs longitudinally spaced from each other for passing through said slots, the inner one of said prongs in a pair latching to said lug means and the outer one latching to said edge when said divider means are inserted.

6. The device according to claim 5 including pads formed on the outer of said prongs for being disposed in spaced relationship with said leg portions to thereby define channels for guiding the tape along said leg portions.

7. The device according to claim 1 wherein said windows in the elongated planar strips are apertures extending therethrough through which the indicia may be viewed.

8. The device according to claim 1 wherein the elongated planar strips are made from a clear material coated on at least one surface with an opaque material, the opaque coating defining a plurality of clear window panes through which the indicia may be viewed.

9. The device according to any one of claims 1, 2, 3, 4, 5, 6, 7 or 8 wherein at least the platen portion of said tape carrier is composed of light transmissive material.

10. A device for selecting and displaying indicia that are on longitudinally movable tapes, the device comprising:

a generally planar panel having parallel track means on one side and an aperture in the member between and extending along the track means, tape carrier means comprised of a body having a front platen portion for being overlaid by one or more tapes and longitudinally spaced apart elements extending integrally from and rearwardly of said platen portion, said body being composed of a material that is sufficiently resilient to allow said elements to flex toward each other for insertion between said track means and to flex away from each other after insertion to effect engagement with said track means and thereby hold said platen portion adjacent said aperture for the indicia on the tape to be presented through the aperture, said carrier including at least one pair of divider members attachable to said body in laterally spaced apart relationship, said divider members having guide portions extending longitudinally over said platen portion of the body and in space relationship therewith to define longitudinally extending channels, respectively, through which opposite edges of the tape pass for being guided longitudinally and for being constrained into proximity with said platen.

11. The device according to claim 10 including:

guide means on the side opposite of said one side of said panel for holding a strip, and a strip for being held in said guide means, said strip having one or more laterally separated windows alignable with the respective tapes and the indicia thereon.

12. The device according to claim 11 including locking means on said tape carrier and said panel that are engageable to lock said carrier to the panel in response to said elements being flexed away from each other when said carrier is in a position along said aperture wherein said tapes align with said windows.

13. The device according to claim 11 wherein the strip defines one or more laterally separated apertures extending through the strip and thereby forming the openings alignable with the tapes and the indicia thereon.

14. The device according to claim 11 wherein the strip is made of a clear material and wherein at least one surface of the strip is coated with an opaque material, the opaque coating defining one or more laterally separated clear panes to form the openings alignable with the tapes and the indicia thereon.

15. The device according to claim 10 including detent means projecting from said divider members, said detent means effecting said engagement between said carrier and track means in response to said elements flexing away from each other.

* * * * *